United States Patent [19]

Gumbert

[11] Patent Number: 4,619,058

[45] Date of Patent: Oct. 28, 1986

[54] FOOTWEAR CORRESPONDING TO PHYSIOLOGY

[76] Inventor: Jerry F. Gumbert, P.O. Box 02011, Columbus, Ohio 43202-2011

[21] Appl. No.: 728,857

[22] Filed: Apr. 30, 1985

[51] Int. Cl.[4] ..... A43B 1/10

[52] U.S. Cl. ..... 36/102; 36/11; 36/50; 24/117

[58] Field of Search ..... 36/102, 103, 105, 112, 36/111, 11, 27, 50; 24/117

[56] References Cited

U.S. PATENT DOCUMENTS

| | | | |
|---|---|---|---|
| 1,104,357 | 7/1914 | Hassel | 36/11 |
| 1,291,958 | 11/1919 | Lund | 36/11 |
| 2,005,007 | 6/1935 | Sandler | 36/11 |
| 2,041,505 | 5/1936 | Woerle | 36/11 |
| 2,143,556 | 1/1939 | Hodaly | 36/50 |
| 2,378,461 | 6/1945 | Bonyhady | 36/50 |
| 2,409,813 | 10/1946 | Timson | 36/105 |
| 2,483,525 | 10/1949 | Brust | 36/50 |
| 2,491,297 | 12/1949 | Brown | 36/105 |
| 2,926,434 | 3/1960 | Morgan | 36/102 |
| 2,958,012 | 10/1960 | Melman | 36/50 |
| 2,973,589 | 3/1961 | Rigsby | 36/11 |
| 3,057,086 | 10/1962 | Rigsby | 36/112 |
| 3,142,911 | 8/1964 | Waters | 36/112 |
| 4,393,550 | 7/1983 | Yang et al. | 24/117 |

FOREIGN PATENT DOCUMENTS

| | | | |
|---|---|---|---|
| 618418 | 6/1934 | Fed. Rep. of Germany | 36/11 |
| 36166 | 3/1906 | Switzerland | 36/50 |

*Primary Examiner*—Werner H. Schroeder
*Assistant Examiner*—Mary A. Ellis
*Attorney, Agent, or Firm*—Porter, Wright, Morris & Arthur

[57] ABSTRACT

An article of footwear comprising a unitary shell enveloping the foot, having a heel collar and an incision therein adapted to accommodate an inserted foot and including an intrinsic pattern of elastic interconnections between predetermined points on the shell corresponding to locations analogous to the natural foot physiology.

2 Claims, 6 Drawing Figures

FOOTWEAR CORRESPONDING TO PHYSIOLOGY

I. FIELD OF THE INVENTION

This invention relates to footwear. A closed cell foam, leather or fabric envelope is structured with elastic interconnections to provide a "shoe" constructed in the same manner and arrangement as the bones, muscles and tendons of the foot are physiologically interconnected.

II. SUMMARY OF THE INVENTION

In the invention, the predetermined physiological area of the foot is enveloped with a foam or other pliable material by constructing an outer shell that is analogous to an additional epidermal layer of tissue and skin. This shell is then laced with an elastic cord in a manner such that the pliable shell can mimic movements of the foot without restriction. An outer covering may overlay the shell and is selected to accomodate the surface abrasion expected on the covering surface. Preferably, the shell is construction by a fusion process such as gluing or welding, rather than sewing. If a sewing process were used, the stitches employed would cause an unequal distribution of stress and apply different degrees of pressure to the body part encircled. It is not, however, an intent of the application, to exclude from the scope of the invention a stiching process whereby stiches are adopted to accommodate to an elastic expansion and contraction. The elastic lacing pattern of the invention accommodates action of the tendons and secures the footwear of the invention to the body in a manner comparable in function to corresponding anatomical connections of body parts.

The materials used in the invention mimic anatomical parts. For example, the closed cell foam envelope is an analog for muscle and adipose tissue; a leather or fabric overlay mimics an outer covering of skin; and the elastic cord lacing corresponds to tendons. In sum, an anatomical analog, such as of the foot, is provided in an apparel construction, such as a shoe.

III. BRIEF DESCRIPTION OF THE DRAWINGS

These and other objects of the invention are more fully understood with reference to the following description of the preferred embodiment taken in conjunction with the drawings in which.

IV. DESCRIPTION OF THE PREFERRED EMBODIMENT

The invention is an item of footwear provided in a manner such that in an outer shell covering for the foot, the physiological/anatomical structure of the foot is mimicked by a footwear construction that mimics an "epidermal" layer. Rather than being simply a "covering" for the foot or a "shoe" as that item is commonly understood, the footwear of the invention is more accurately described as a realistic extension of the foot physiology. The footwear construction "worn" is intrinsically interrelated to the foot physiology.

Figure 5A:
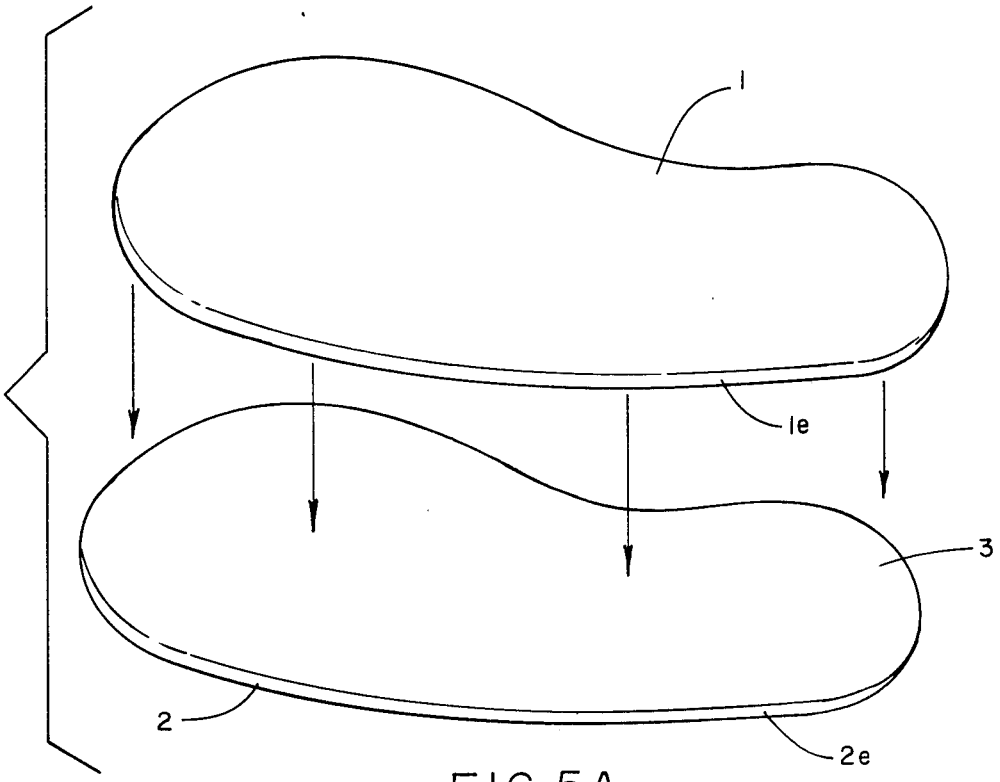
FIG. 5A shows an intermediate step in construction of the footwear with two sides formed.

The following sequence illustrates an example of a manner in which footwear of the invention is constructed:

If done on a custom basis, an outline of the foot is first made, allowing a sufficient "oversize" for the length and breadth of the foot to accommodate movement when in action. The pattern is used to determine the cut of two identical pieces of a pliable foam material so that an upper and a lower piece are provided. These are shown as 1 and 2 of FIG. 5A. The top of the lower piece of foam, 2, on which the foot will actually rest, may be covered with double-split leather, 3, to provide protection as well as positive traction. An adhesive or glue is applied to the outer side edges of both pieces of foam, 1*e* and 2*e*, and the two pieces are mated edge to edge—starting at the most anterior "toe" portion, then gluing the posterior "heel" portion and then the lateral and medial sides to provide a single seam, shown in FIG. 5B at 4. A shell or balloon which will envelope the foot is thereby formed. The plantar, sole surface of the shell formed from material piece 2 is covered with a protective layer of double split leather and the dorsal surface formed from material 1 is covered with fabric, leather or some other covering or combination depending upon anticipated use of the footwear.

The plantar surface may also be covered with a rubber sole of a nature determined by anticipated use of the shoe.

Figure 5B:
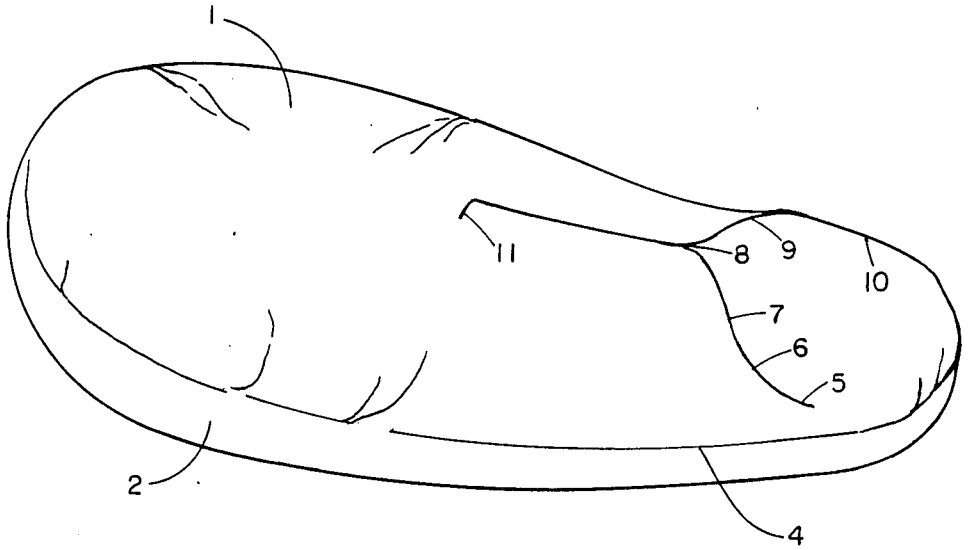
FIGS. 5B shows an initial balloon structure for the footwear.

After the shell envelope is formed, an incision is made, with reference to FIG. 5B beginning on the dorsal surface of the shoe at the posterior of the heel area on the lateral side 5 and proceeding forward in a gently arching fashion so that the incision will remain below the lateral malleolus, 6, and then curving more sharply toward the axis of the foot 7 after passing the malleolus. [As used herein, reference to anatomical features is derived from *Color Atlas of Foot and Ankle Anatomy,* McMinn, R.M.H., et al. Appleton Centure; C1982 Wolfe Medical Publications, Ltd., London; Library of Congress Catalog Number 82-50763, particularly pages 56, 57, 58 and 59, which are incorporated by reference herein.

After crossing the longitudinal axis of the foot, 8, the incision curves downward below the medial malleolus and extends backwards toward the posterior medial part of the heel 10. A resulting tab of material is formed which becomes the heel piece and rests against the achilles tendon. A second incision is then made along the longitudinal axis of the foot from the most anterior point of the curved incision described above 8 forward to approximately the most anterior point of the cuniform bones of the foot, 11.

Figure 1:
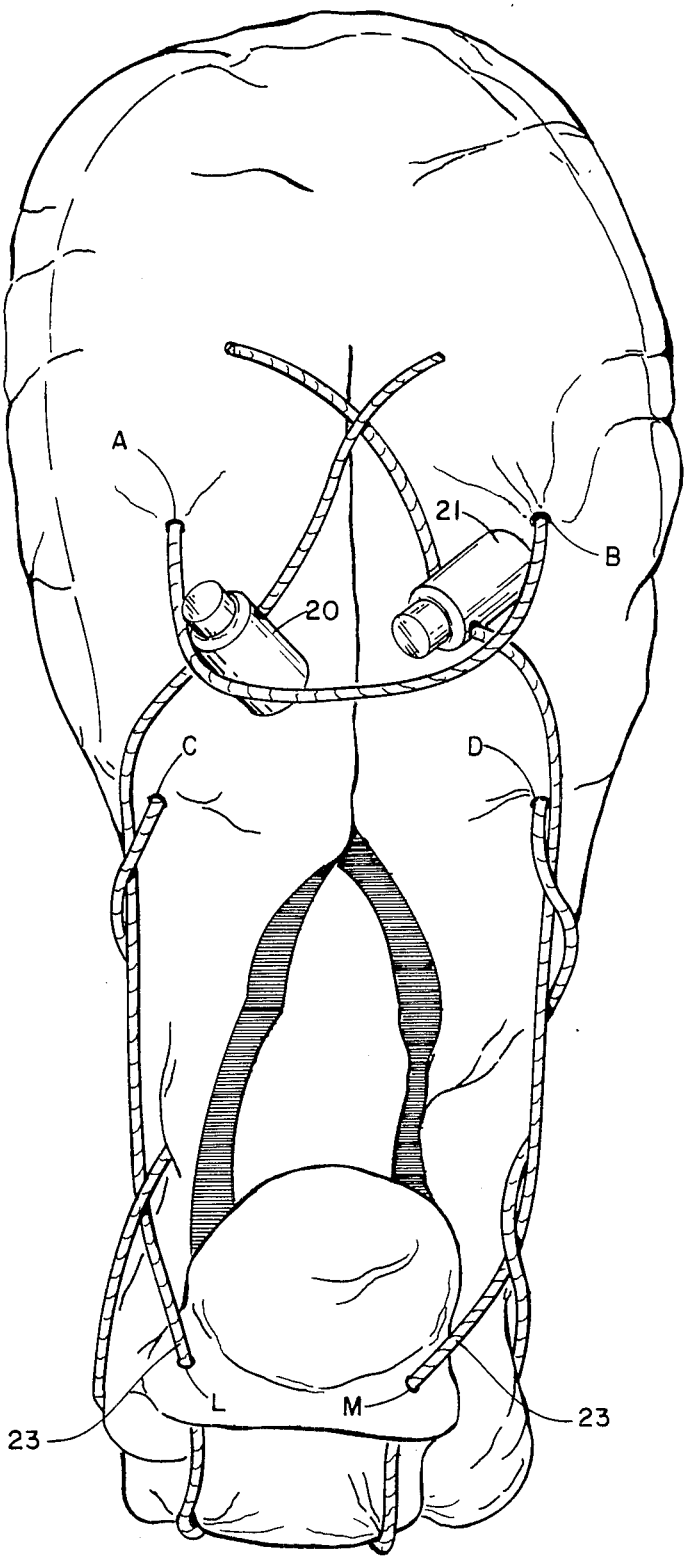
FIG. 1 is a top view of footwear of the invention.
Figure 2:
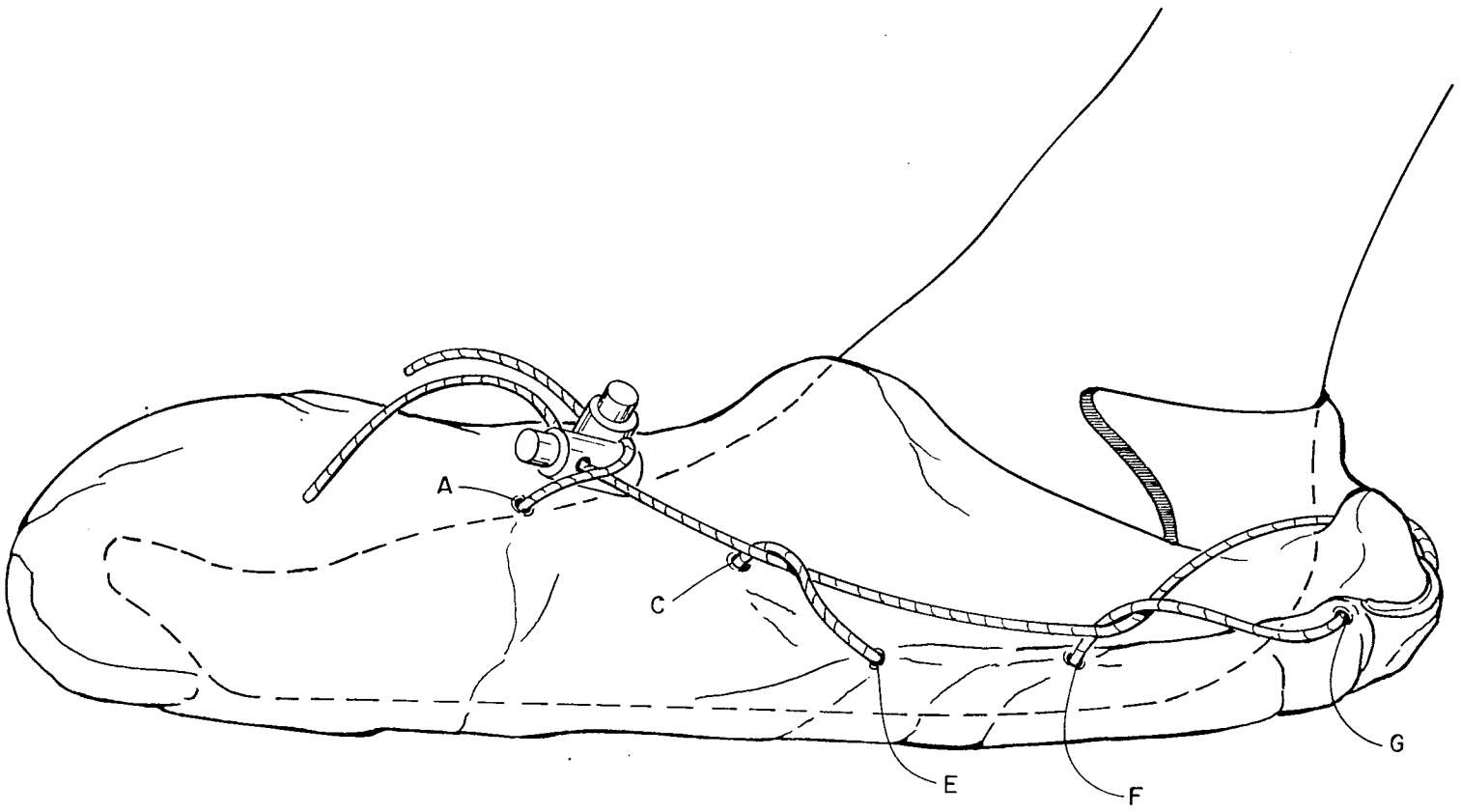
FIG. 2 is a medial side view.
Figure 3:
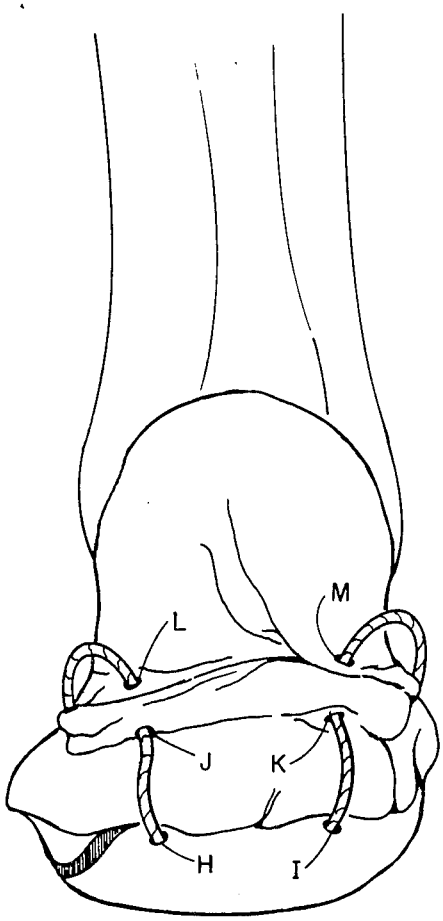
FIG. 3 is a view from the back showing the heel configuration.
Figure 4:
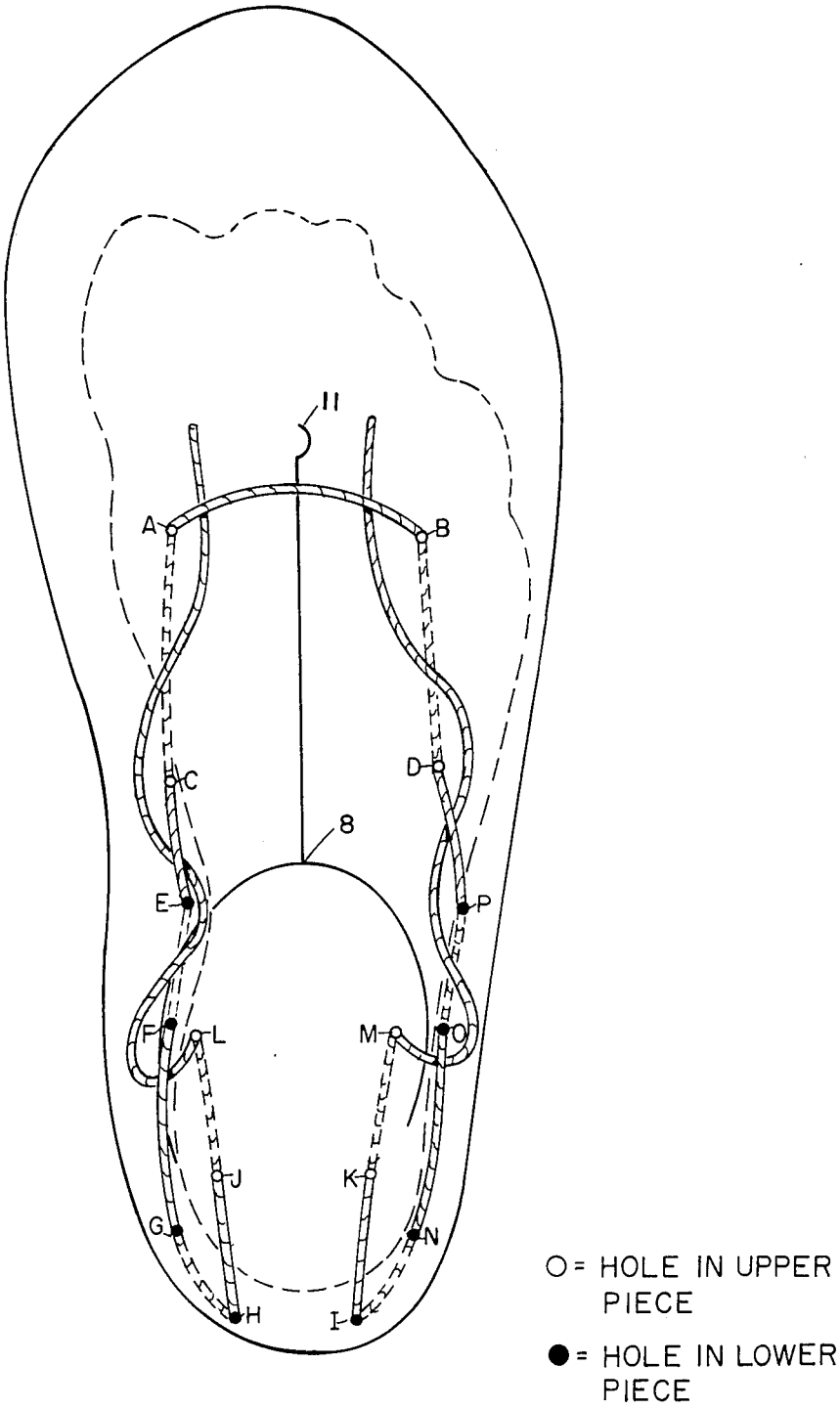
FIG. 4 is a top view showing the portion of a foot in the footwear and indicating physiological points for connecting relationships of the lacing structure.

Sixteen (16) holes are then formed into the shell at the relative positions indicated in FIG. 4 and as also shown in FIGS. 1–3 by the stated letters:

(A) above the base of first metatarsal and corresponding to the extensor longus hallucis;

(B) above the base of the 4th metatarsal and corresponding to the extensor longus digitiorim;

(C) to the side of the most anterior, inferior aspect of the medial side of the extensor retinaculum;

(D) to the side of the peroneus tertius and corresponding to the lateral side of the extensor retinaculum;

(E) corresponding to the attachments of the tibialis anticus;

(F) corresponding to the attachments of the tibialis posticus;

(G) to the medial side and anterior portion of the calcaneus and corresponding to the flexor retinaculum;

(H) corresponding to medial inferior attachment of achilles tendon;

(I) corresponding to lateral inferior attachment of achilles tendon;

(J) and (K) in the heel tab (approximately 2" above the inferior attachments) corresponding to the medial and lateral superior aspects of the calcaneus and the planaris;

(L) and (M) (approximately 3"-3½" above the inferior attachment in heel tab approximately 1.0 to 1.5 inch above holes (J) and (K) and slightly further to the medial and lateral aspects and corresponding to where the soleus attaches to the achilles tendon;

(N) on lateral and anterior part of calcaneus and corresponding to the peroneal retinaculum;

(O) on lateral side of foot below the lateral malleolus and corresponding to the abductor minimui digiti and peroneus longus;

(P) to the side of the attachment of the peroneous brevis.

These 16 locations provide connecting points for an integrated elastic cord. In each of the drawings, each letter is uniformly used to indicate the same physiological location.

The elastic interconnection between these 16 points is predetermined because movements of the foot upon the ankle joint involve four types of action: (1) inversion—the turning of the sole of the foot inwards; (2) eversion—the turning of the sole of the foot outwards; (3) flexion—the approximation of the dorsum of the foot to the front of the leg; and (4) extension—the drawing up of the heel of the foot while simultaneously pointing the toes downward.

Inversion of the foot is accomplished primarily by the tibialis anticus and tibialis posticus muscles. Eversion is accomplished primarily by the peronei muscles (peroneous longus and peroneous brevis). Normally these two groups of muscles antagonize each other causing the sole of the foot to be neutral (neither inverted nor everted). The extreme eversion of a foot occasionally seen when the lower end of the fibula has been fractured is caused by the lack of resistance normally offered by that bone to the peronei muscles.

Extension of the tarsal bones upon the tibia and fibula is produced by the muscles gastrocnemius, soleus, plantaris, tibialis posticus, peroneus longus and brevis, flexor longus hallucis and flexor longus digitorium. Flexion of the tarsal bones upon the tibia and fibula is produced by the muscles tibialis anticus, peroneus tertius, extensor longus digitorium and extensor proprius hallucis. Again these two groups of muscles antagonize each other and when operating properly hold the foot in a position of equilibrium.

In a similar fashion the lacing pattern of the footwear herein securely holds the shoe on the foot while allowing complete freedom of movement through the use of antagonizing groups of holes and laces. The eight holes on the medial side of the shoe invert the sole of the shoe. (Holes A, C, E, F, G, H, J, L). The eight holes on the lateral side of the shoe evert the sole of the shoe. (Holes, B, D, I, K, M, N, O, P).

Eight holes anterior to the lateral arch of the foot, four (A, C, E, F) on the medial side and four (B, D, O, P) on the lateral side, flex the toe, while eight holes posterior to the lateral arch, four (G, H, J, L) on the medial side and four (I, K, M, N) on the lateral side extend the shoe.

When at equilibrium, the sole of the shoe is parallel to the ground and is neither inverted nor everted. Any subsequent movement to invert or extend the foot is counterbalanced by an appropriate stretching of the elastic in the holes accomplishing eversion and flexion. In this manner the shoe continually conforms to the shape and position of the foot throughout its full range of motion.

An elastic shock cord may be used as a lacing material (approximately 60" of cord is used in a men's size 11-12). As shown in FIG. 4, lacing begins at the two most anterior holes A and B so that a loop is formed over the upper exterior surface of the shoe connecting the two holes. The lacing continues from front to back with the medial and lateral sides laced separately. Thus exterior stitches connecting adjacent "holes" are formed along the medial (A to C to E to F to G to H as shown in FIG. 2) and lateral (B to D to P to N to I) sides of the foot, upwards adjacent the arch of the foot, upwards in alignment to the cuboid bone. The laces are then stitched through the heel form a collar around the achilles tendon, leaving the laces on the footwear exterior. The loose ends of the laces are then respectively drawn back on each side through the medial exterior stitches F and G and lateral N and O stitches and are again looped thru the most exterior stitch on each side (C to E) and (D to P). The medial lace remains on the medial side and the lateral lace remains on the lateral side. Both ends of the lace are inserted under the initial loop made connecting the two anterior holes A and B. Spring locks or other stops such as shown in FIG. 1 at 20 and 21 may be attached to the two ends of the lace and the footwear is then completed. If additional tension is desired the lace may be drawn backward and inserted under the exterior loops formed by the lace as it was threaded from the heel through the first exterior stich, i.e. in the locations indicated as 22 and 23 in FIG. 1.

In contrast with conventional shoes, a stiff sole is unnecessary and the footwear herein has no edges. There is neither a positive nor a negative heel and the arch has no shank. There can be a greater length and breadth of shoe without sloppiness of action and the footwear is balanced, both at rest and in motion. The invention does not "hang" on the foot from above but is supported and attached to the foot in the same manner that foot bones are attached to leg bones. The invention is adjustable to sock thickness, foot swelling, foot growth, and other wear variables. It may be made fully waterproof and "breathable" by adopting the material of construction and/or providing ventilating holes. The invention allows extension and flexion of the achilles tendon and provides improved traction through a broader surface area in which natural contact points of the foot strike first. In this regard, the footwear herein may eliminate the need for spikes in athletic shoes.

The ease and simplicity of construction permits the economical "custom" fabrication of footwear to accommodate left/right foot differences in persons. Since there is one basic pattern piece and lasts are not required the shoe can be built economically on a custom basis. The footwear is light in weight at rest and virtually weightless in action; it provides modest uniform pressure across the entire foot and hence may reduce the severity and/or incidence of podiatric maladies such as blisters, callouses, corns, bunions, hammer toe, and ingrown nails. Circulation is improved and foot, leg and back fatigue, as well as the stiffness in hips caused by conventional footwear is reduced. The footwear is soft, adjustable and conforms to the foot and does not force the foot to conform to the shoe as in conventional shoes.

While the suitable physiologically appropriate materials of construction may be evident to those of skill in the footwear art, a preferred "envelope" material for the footwear shell is manufactured by Uniroyal, Inc. under the trademark Ensolite® comprising a closed cell foam made from polyvinyl chloride and nitrile rubber manufactured in nominal thickness of from 0.125 inch to 1.75 inch. Typical elastic lace materials include a cord of nominal diameter of 0.187 inch which will stretch 50% under a weight of 3 pounds, 75% under 5 pounds and 100% under 7 pounds and a similar cord 0.250 inch in diameter which will stretch 50% under 10 pounds, 75% under 12 pounds and 100% under 20 pounds. As in most items of apparel, size, comfort and purpose, given the predetermined design are factors determining the specific materials and their strength and durability requirements needed for a given product.

Although the preferred is specifically described herein as a particular embodiment, the stepwise fabrication and multiple elements referred to have obvious equivalents. For example, an unseamed envelope may be intrinsically formed as a single element; the elastic lacing may consist of elastic interconnections between the points specified; the lacing "holes" referred to are statements of relative physiological location with respect to the anatomical feature specified. Thus, in view of the foregoing disclosure, variations of the invention will be evident and it is not intended to exclude them from the scope of the following claims in which:

What is claimed is:

1. Footwear comprising a unitary shell enveloping the foot, having a heel collar and an incision therein adopted to accommodate a foot inserted therein, said shell including elastic interconnections between points therein at locations adjacent the following anatomical features on the medial side of the shoe:

(1) beginning above the base of first metatarsal and corresponding to the extensor longus hallucis;
(2) to the side of the most anterior, inferior aspect of the medial side of the extensor retinaculum;
(3) to the location of attachments of the tibialis anticus;
(4) to the attachments of the tibialis posticus;
(5) to the medial side and anterior portion of the calcaneus and corresponding to the flexor retinaculum;
(6) to the medial inferior attachment of achilles tendon;
(7) to the medial and lateral superior aspects of the calcaneus and the planaris; and
(8) to the medial and lateral aspects corresponding to where the soleus attaches to the achilles tendon.

and at locations adjacent the following anatomical features on the lateral side of the shoe:

(1) beginning above the base of the 4th metatarsal and corresponding to the extensor longus digitiorim;
(2) to the side of the peroneus tertius and corresponding to the lateral side of the extensor retinaculm;
(3) to the side of the attachment of the peroneous brevis;
(4) to below the lateral malleolus and corresponding to the abductor minimui digiti and peroneus longus;
(5) to the lateral and anterior part of calcaneus and corresponding to the peroneal retinaculum;
(6) to the lateral inferior attachment of achilles tendon;
(7) to the medial and lateral superior aspects of the calcaneus and the plantaris; and
(8) to the medial and lateral aspects corresponding to where the soleus attaches to the achilles tendon.

2. The footwear of claim 1 in which the elastic interconnections between locations corresponding to the foot tendons include an elastic lace cord which in a single length interconnects all such locations and at the end thereof has a spring lock to maintain the tension of the cord and allow infinite adjustment of the footwear with respect to the foot.

* * * * *